US012789039B2

(12) United States Patent
Luna Grenier

(10) Patent No.: US 12,789,039 B2
(45) Date of Patent: Nov. 10, 2026

(54) BOARD TO SAFELY IMPROVE BALANCE CONTROL DURING EXERCISE

(71) Applicant: 9404-1290 Québec inc., Montréal (CA)

(72) Inventor: Francis Luna Grenier, Montréal (CA)

( * ) Notice: Subject to any disclaimer, the term of this patent is extended or adjusted under 35 U.S.C. 154(b) by 0 days.

(21) Appl. No.: 18/408,838

(22) Filed: Jan. 10, 2024

(65) Prior Publication Data

US 2024/0226652 A1 Jul. 11, 2024

Related U.S. Application Data

(60) Provisional application No. 63/479,259, filed on Jan. 10, 2023.

(51) Int. Cl.

| | |
|---|---|
| ***A63B 22/16*** | (2006.01) |
| ***A63B 21/00*** | (2006.01) |
| ***A63B 71/06*** | (2006.01) |

(52) U.S. Cl.

CPC ..... *A63B 22/16* (2013.01); *A63B 21/4034* (2015.10); *A63B 2071/0655* (2013.01); *A63B 2071/0694* (2013.01); *A63B 2208/0204* (2013.01)

(58) Field of Classification Search

CPC ..... A63B 22/16; A63B 21/4034; A63B 2071/0655; A63B 2071/0694; A63B 2208/0204

USPC ..... 623/53; 36/118.4, 117.5, 115, 114, 113, 36/103, 97; 482/142, 146

See application file for complete search history.

(56) References Cited

U.S. PATENT DOCUMENTS

| | | | |
|---|---|---|---|
| 2,930,613 | A | 3/1960 | Katz |
| 2,941,801 | A | 6/1960 | Pedersen |
| 3,361,427 | A | 1/1968 | Paves |
| 3,438,626 | A | 4/1969 | Modla |
| 3,471,144 | A | 10/1969 | Lemaire |

(Continued)

FOREIGN PATENT DOCUMENTS

| | | | |
|---|---|---|---|
| CA | 2428645 | A1 | 5/2002 |
| CA | 2206028 | C | 10/2006 |

(Continued)

OTHER PUBLICATIONS

Patentability search materials: StrongTek Anti Fatigue Balance Board, Standing Desk Balance Boards, Sit Stand Desk Mat Accessory, Wobble Foot Rocker, Balancing Mat, Exercise Core Strength, Comfortable Standing. Retrieved Apr. 12, 2021 from website: https://www.amazon.com/StrongTek-Anti-Fatigue-Accessory-Exerciser-alancing/dp/B07FNBFK9V/ref=pd_lpo_229_t_1/138-8735840-6967566?

(Continued)

*Primary Examiner* — T. Scott Fix

(74) *Attorney, Agent, or Firm* — Anglehart et al.

(57) ABSTRACT

A reflex board for improving control over one's center of gravity, displacement and/or position by providing a main significantly stable primary stable position and at least one relatively secondary stable position with an inclination of between about 2° and about 7° with respect to the primary stable position. This secondary stable position been steep enough for the user to notice the tilting of the platform and small enough to prevent complete lost of balance, all the while providing enough stability to keep control of the movement and thus safely complete the exercise without significant perturbation occasioned by the transition between the stable positions.

20 Claims, 7 Drawing Sheets

(56) References Cited

U.S. PATENT DOCUMENTS

| | | | | |
|---|---|---|---|---|
| 3,485,493 | A | 12/1969 | Pitkanen | |
| 3,586,321 | A | 6/1971 | Gehrke et al. | |
| 3,612,520 | A | 10/1971 | Chang et al. | |
| 3,961,787 | A | 6/1976 | Studebaker et al. | |
| 4,491,318 | A | 1/1985 | Francke | |
| 5,048,823 | A | 9/1991 | Bean | |
| 5,292,296 | A | 3/1994 | Davignon | |
| 5,584,787 | A | 12/1996 | Guidry | |
| 5,643,154 | A | 7/1997 | Awbrey et al. | |
| 5,643,164 | A * | 7/1997 | Teff | A63B 23/08 482/79 |
| 5,647,830 | A | 7/1997 | Togao | |
| D460,507 | S | 7/2002 | Stewart | |
| 6,652,432 | B2 | 11/2003 | Smith | |
| 6,666,797 | B1 | 12/2003 | Martin | |
| 6,712,860 | B2 * | 3/2004 | Rubie | A61F 2/66 623/53 |
| 6,945,920 | B1 | 9/2005 | Kemery et al. | |
| 7,052,449 | B2 | 5/2006 | Chen | |
| 7,625,294 | B1 | 12/2009 | Isaac et al. | |
| 7,686,751 | B2 | 3/2010 | Carlson et al. | |
| D693,545 | S | 11/2013 | Battaglino | |
| 8,734,308 | B1 | 5/2014 | Joslin | |
| D745,938 | S | 12/2015 | Joslin | |
| 9,545,533 | B2 | 1/2017 | Boyer | |
| D785,731 | S | 5/2017 | Stack | |
| 9,700,756 | B2 | 7/2017 | Franche | |
| D798,397 | S | 9/2017 | Bellevue | |
| 10,434,371 | B2 | 10/2019 | Shoffler | |
| D870,828 | S | 12/2019 | Dicharry | |
| 2003/0186794 | A1 | 10/2003 | Vittone | |
| 2004/0082396 | A1 | 4/2004 | Basu et al. | |
| 2008/0020856 | A1 | 1/2008 | Rosa | |
| 2010/0167886 | A1 | 7/2010 | Ko | |
| 2014/0228187 | A1 * | 8/2014 | Moscarello | A63B 22/18 482/142 |
| 2016/0030800 | A1 | 2/2016 | McClure et al. | |
| 2016/0199699 | A1 | 7/2016 | Klassen | |
| 2019/0054348 | A1 | 2/2019 | Polinsky | |
| 2019/0091510 | A1 | 3/2019 | Wallace | |
| 2019/0308072 | A1 | 10/2019 | Metcalfe et al. | |
| 2023/0201008 | A1 * | 6/2023 | Pusch | A61F 2/68 623/53 |

FOREIGN PATENT DOCUMENTS

| | | | | |
|---|---|---|---|---|
| CN | 103381290 | A | 11/2013 | |
| CN | 103638641 | A | 3/2014 | |
| CN | 103638667 | B | 5/2016 | |
| CN | 209405603 | U | 9/2019 | |
| CN | 209885126 | U | 1/2020 | |
| DE | 3433892 | C2 * | 3/1996 | A63B 26/003 |
| EP | 2049207 | B1 | 3/2011 | |
| EP | 2982420 | B1 | 9/2018 | |
| FR | 2986159 | B1 | 3/2014 | |
| JP | 2013-506513 | A | 2/2013 | |
| KR | 10-2015-0093387 | A | 8/2015 | |
| KR | 10-2017-0011422 | A | 2/2017 | |
| WO | 2008/014533 | A1 | 2/2008 | |

OTHER PUBLICATIONS

Patentability search materials: Pedalo Foot Trainer. Retrieved Apr. 12, 2021 from website: https://www.physiosupplies.eu/pedalor-foot-trainer.

* cited by examiner

BOARD TO SAFELY IMPROVE BALANCE CONTROL DURING EXERCISE

This application claims priority to U.S. provisional patent application 63/479,259 filed Jan. 10, 2023, the contents of which are hereby incorporated by reference in their entirety.

TECHNICAL FIELD

The present patent application relates to balancing boards.

BACKGROUND

Balancing boards come in many shapes and are used for a wide variety of exercises. Although balance boards are generally unstable apparatus used to improve balance reflexes and to develop stabilizing muscles, some boards provide a limited region of stability and form a separate category of balance boards. In fact, such balance boards are designed to help the user gain better control over their center of gravity (position and/or displacement) while executing exercises that could not be performed while standing on the more common wobbly or unstable balance board. Their main feature is a center area providing the user with a stable initial position within which the exercise must be completed. The idea is to improve the overall execution of those exercises and control over the position and displacement (center of gravity) by penalising the user when it is moved out of this center area, rendering the board unstable and significantly disturbing the exercise's execution. The user is then unable to complete the exercise and must therefore repeat the action until he is able to constrain his center of gravity within the board's stable area if he or she wants to complete it. This category includes balance boards designed to improve a golfer's swing, where the user is rocked forward or backward when the center of gravity is displaced "outside the threshold range" of the central stable area as presented in the patent application publication US20080020856A1. Therefore, additional awareness, freedom of movement and skills are needed simply to prevent falling off when the board is unstable. This prevents the user to complete the exercise and, in some cases, risk provoking injuries especially if the user is using additional free-weights or an elderly or doing rehabilitation exercises.

SUMMARY

Applicant has discovered that the problem of improving control over one's center of gravity, displacement and/or position while requiring a significantly stable surface to performing some exercise can be overcome by using a platform providing a main primary stable position and at least one relatively wide secondary stable position with an inclination of between about 2° and about 7° with respect to the previous stable position. Therefore, the secondary stable position is steep enough for the user to notice the tilting of the platform and small enough to prevent complete lost of balance, all the while providing enough stability to keep control of the movement and thus safely complete the exercise without significant perturbation occasioned by the transition between the stable positions.

In some embodiments, the primary rear fulcrum has a surface with a constant, adjustable or gradually changing radius of curvature to provide a primary rear position of the platform.

Some embodiments comprise at least one additional rear fulcrum, where the platform can be in an additional rear stable position when between and supported by two rear fulcrums or can be in an additional rear unstable position when the effective pressure-point or center of pression controlled with the user's center of gravity, displacement and/or position is applied on and is supported by only one of the rear fulcrums.

In some embodiments, the position of at least one of the fulcrums is adjustable relatively to the other fulcrum's positions.

In some embodiments, the fulcrums extend across (from both one lateral side to the other lateral side) of the platform or they have at least a contact point on each lateral sides of the platform to provide lateral stability.

In some embodiments, a base structure comprising one or more fulcrums is used to support the platform.

In some embodiments, the fulcrums are fixed to the bottom surface of the platform.

In some embodiments, the base is coupled to the bottom surface of the platform with a coupling mechanism that may allow to adjust its position.

In some embodiments, the base is subdivided, where a front base support one of the base's subdivisions comprises only the front fulcrums.

In some embodiments, the position of the front base support can be adjusted independently to the rear fulcrums with a coupling mechanism.

In some embodiments, an indiscrete adjustable coupling mechanism comprising at least one track and at least one anchor for each of the tracks used to couple at least one base part to the bottom of the platform.

In some embodiments, the bottom surface of the platform has visual indicators along the coupling mechanism components to help the user align and position the base support part(s) relative to the bottom surface of the platform.

In some embodiments, the top surface of the platform is at least partially covered with a mat to give texture to it and/or help the user to adhere to the top surface of the platform.

In some embodiments, the top surface of the platform or the mat is textured to create a tactile cue for the user, to help the user to adhere to the top surface of the platform and/or to give the user constant feedback information about the effective pressure-point.

In some embodiments, additional graphic and visual elements are added to help the user position himself on the platform and/or allows to personalize it.

A user can use these embodiments to improve his control over his center of gravity when executing a chosen exercise by allowing him to complete the exercise on the secondary stable position when the center of gravity is moved outside the primary stable position's threshold and thus repeating the exercise until it is executed without ever leaving the primary stable position. In some cases, the user may be barefoot when using the apparatus to better feel the textured mat.

BRIEF DESCRIPTION OF THE DRAWINGS

The invention will be better understood by way of the following detailed description of embodiments of the invention with reference to the appended drawings, in which.

DETAILED DESCRIPTION

In this patent, the term "effective pressure-point" is understood to mean "the center of pressure equivalent to all the forces applied on the board by the user and controlled with his position, displacement and/or the center of mass".

In this patent, the term "barefoot" is understood to mean "wearing thin socks without shoes or not wearing any shoes or socks".

Figure 1A:
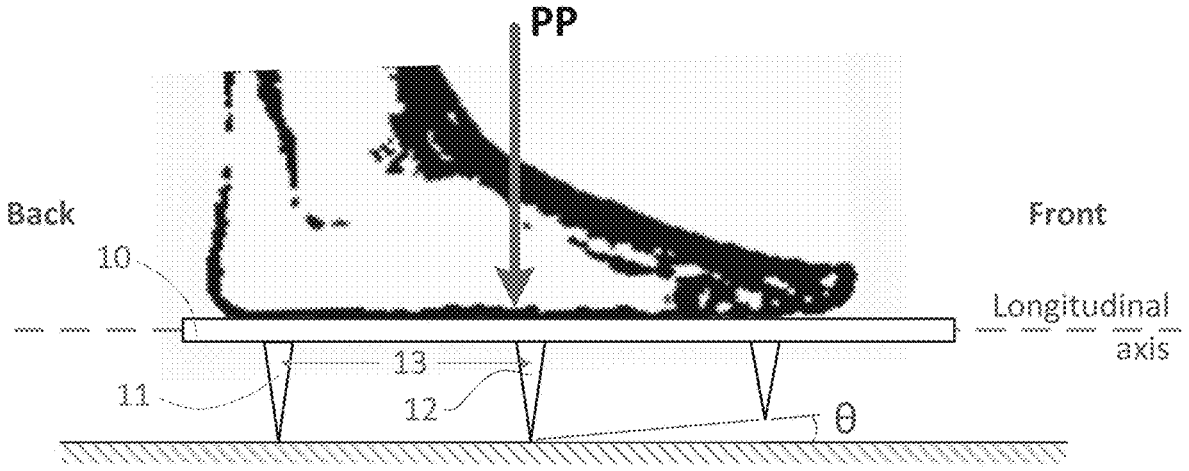
FIG. 1A illustrates a schematic side view of a basic embodiment in the primary stable position when the platform is supported by the primary rear and front fulcrums.
Figure 1B:
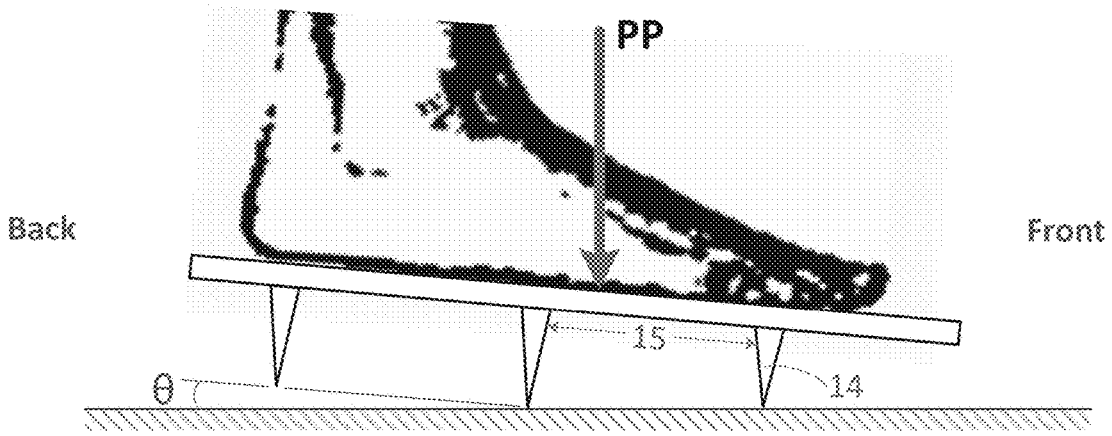
FIG. 1B illustrates a schematic side view of a basic embodiment in the secondary stable position when the platform is supported by the primary and secondary front fulcrums.

FIG. 1A presents a schematic side view of a basic embodiment in the primary stable position and allows to visualize the main working principles of the apparatus. In the illustrated embodiment, the foot of a user standing on top of the platform 10 in the primary stable position supported by a primary rear fulcrum 11 and the primary front fulcrum 12. The platform 10 will remain in this configuration if the effective pressure-point PP stays concentrated within the first stable area 13 situated between the primary rear fulcrum 11 and the primary front fulcrum 12. With well-positioned fulcrums the platform would stay in this primary stable position as long as the user keeps proper control over his center of gravity and effective pressure-point. The primary rear fulcrum 11 is disengaged and the platform 10 is rendered temporarily unstable, pivoting around the primary front fulcrum 12, when the user is unable to constrain his center of gravity within the platform's first stable area 13 and his effective pressure-point PP is displaced over the primary front fulcrum 12. In the case where the user is unable to bring back his effective pressure-point PP and the secondary front fulcrum 14 is engaged, the platform assumes its maximal inclination θ corresponding to the secondary stable position has illustrated at FIG. 1B. This schematic side view shows the secondary stable position, where the platform 10 is supported by the primary front fulcrum 12 and the secondary front fulcrum 14. The platform 10 stays in this secondary stable position as long as the user's effective pressure-point PP is applied within the second stable area 15 between the front fulcrums. The applicant has found that this secondary stable position should have an inclination with respect to the primary stable position θ of between about 2 and about 7 degrees. The inclination θ must be smaller than about 7 degrees so that the secondary stable configuration remains level enough to allow the user to easily retain stability and safely complete the exercise. The inclination θ must be steep enough (greater than about 2 degrees) to ensure that the tilting of the platform 10 becomes perceptible and discernable by the user during the exercise. Therefore, the embodiments can be used as a tool to help the user realize when his center of gravity is displaced in front of the selected range (first stable area 13) allowing him to increase awareness of his center of gravity, develop better control over his balance, improve coordination of his body segments, improve execution of the exercises, develop sensory-motor cognitive association, and favor better performances in the end. The sensory-motor cognitive association can be developed and improved gradually through positive experiences (rewarding experiences of completing an exercise without engaging the second stable position) and/or feedbacks when using the apparatus. Understandably, if the user is using one of the embodiments to improve his balance control for relatively risky exercise such as free weightlifting (snatch, clean and jerk, deadlifting, powerlifting, squatting, etc.) where the possibility of injuries is present, it is primordial for the user to stand on a reliable and stable surface here provided by either of the platform's stable positions. Since it would also be particularly true for cases where the user may be frail, unstable or at risk of worsening pre-existing injuries, such a product will be very useful for physical rehabilitation exercises or to allow elderlies to safely improve their balance, coordination and strengthen their muscles. Some embodiments have adjustable fulcrums where their position can be changed to move longitudinally or lengthen the stable positions 13 and 15. Adjustable fulcrums are useful to change the balancing difficulty of the board and/or to be used for different exercises and/or to adjust the board to the user's physical proportions (for example, his feet size).

Figure 1C:
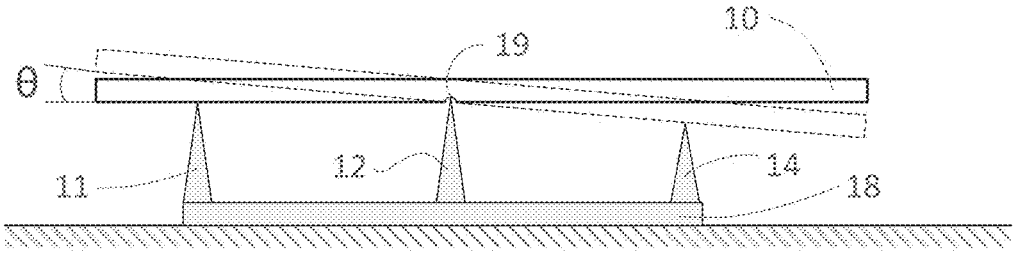
FIG. 1C illustrates a schematic side view of an alternative embodiment with a base for supporting the platform.

FIG. 1C illustrates a schematic side view of an alternative embodiment with a base 18 comprising the fulcrums (11, 12 and 14) resting on the floor and a platform 10 resting on top for supporting a standing user. In this embodiment, the platform can pivot around the contact point 19 with the primary front fulcrum 12 to engage the secondary stable position displayed in dotted line.

Figure 2:
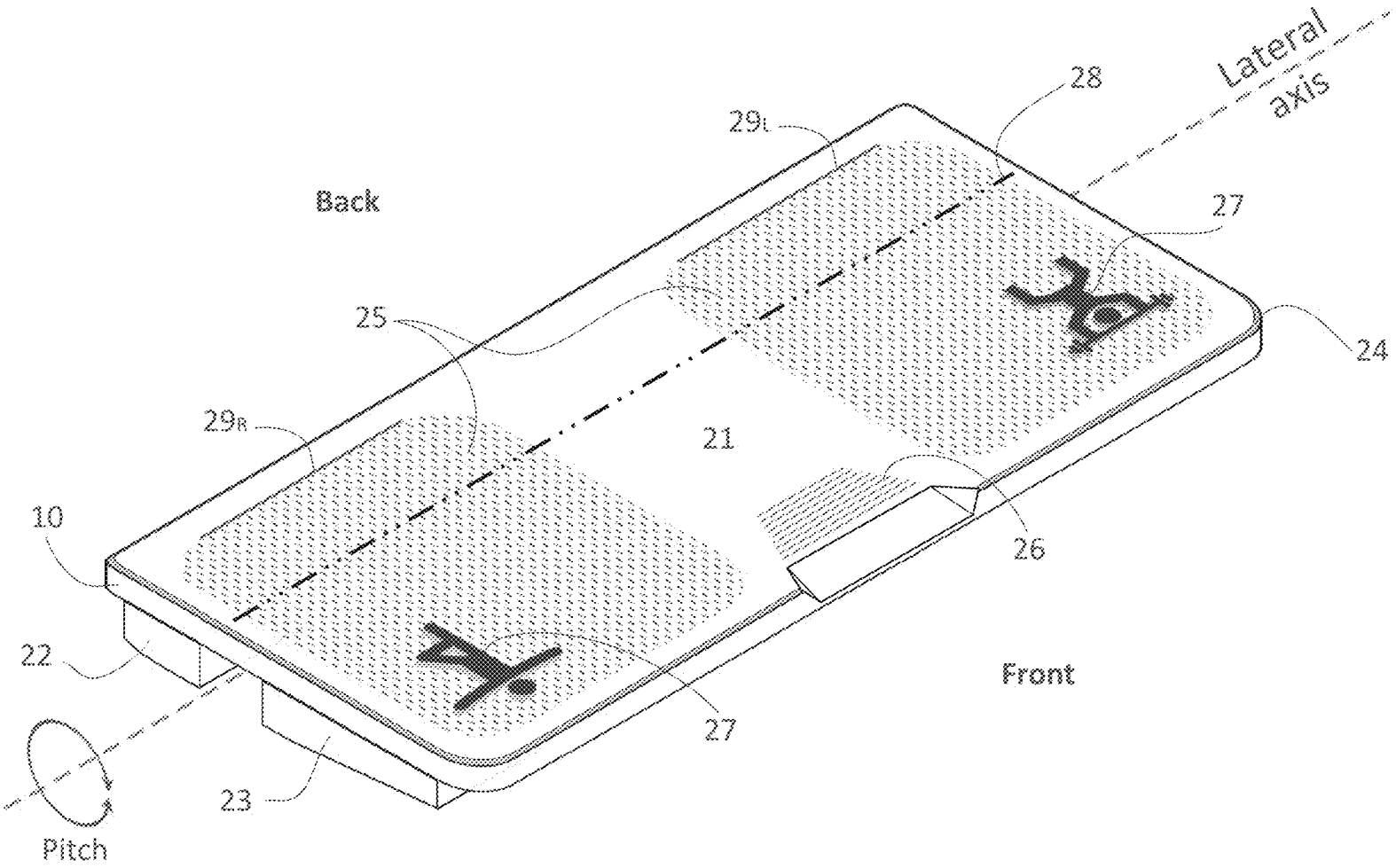
FIG. 2 illustrates a schematic 3D view of a more complete embodiment of the apparatus.

FIG. 2 presents a schematic 3D view of a more realistic and complete embodiment, where the platform 10 supported by more complex adjustable rear support 22 and front support 23 is fully stable around the vertical and longitudinal axes. It can only be tilted around the lateral axis (pitch). This illustration also shows examples of possible customizations that can be added to the top surface 21 of the platform 10 namely, an additional mat 24 covering the top surface, some adherent textured relief 25, some handling grip 26, some markings 27 and some coated, painted, tinted, carved, or etched visual and tactile cues to indicate an arbitrary center of first stable area 28. The visual and/or tactile cues indicating the heels positioning 29 can be replaced by an edge stop added to the rear edge of the platform 10 where the user can rest his heels against. The textured relief 25 can increase the coefficient of friction of the platform and can help the user to better perceive the movement of the platform (can give better feedback information about the effective pressure-point), specially when the user is barefoot.

Figure 3:
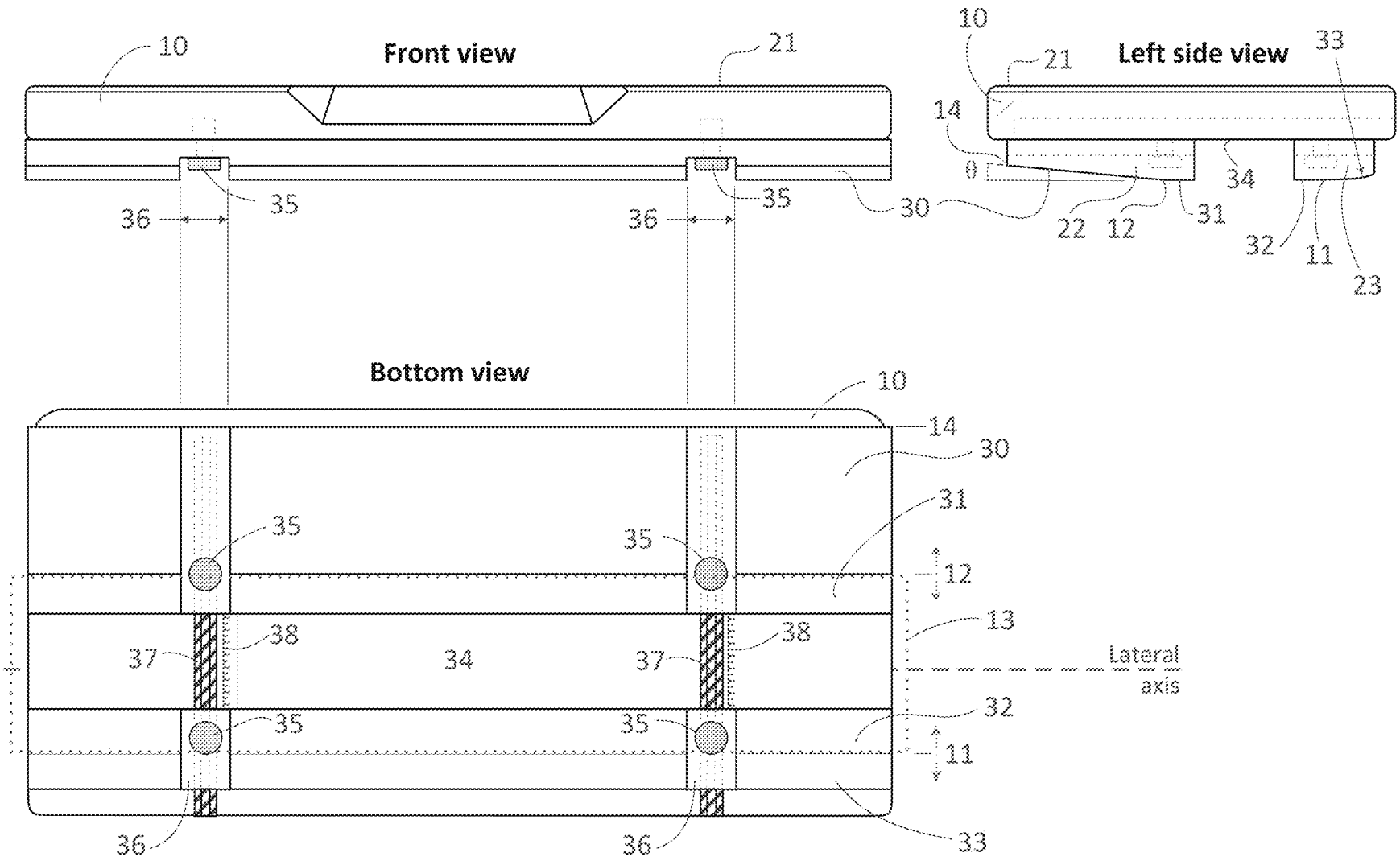
FIG. 3 illustrates a technical drawing of the third angle projection of the embodiment illustrated in FIG. 2.

FIG. 3 presents a technical drawing of the third angle projection of the embodiment illustrated at FIG. 2, where the front, bottom and side views are schematized. This drawing helps to better visualize the shape, layout and working principal of this embodiment's adjustable supports used to control the range or the longitudinal position of the fulcrums and stable areas. The front view best shows the anchors 35 and the grooves 36 allowing these anchors to be fitted in the supports to anchor the supports 22 and 23 to the platform 10. In this embodiment, the anchors 35 are screws pared with anchoring rails 37 visible from the bottom view. The bottom view also shows laser engraved or painted rulers 38 next to and parallel with each anchoring rails 37 which are used as visual cues enabling the user to position, align and/or reposition the supports to the desired arrangement onto the bottom surface 34 of the platform. Someone skilled in the art will understand that the anchoring method can be any type of the coupling technics described in the art, such as modular encased parts. The first stable area 13 is identified on the bottom view with a grey dotted square between the rear pivot point 11 and front pivot point 12. In this embodiment, the side view illustrates the shape of the supports, where the front support 22 as a leveled surface 31 behind the primary front fulcrum 12 and a sloped surface 30 between the primary front fulcrum 12 and a secondary front fulcrum 14 with a specific inclination θ. Correspondingly, the rear support 23 also comprises of a leveled surface 32 in front of the rear fulcrum 11 and its curved surface 33. Evidently, in this embodiment, the platform would get tilted by a maximum of A in the second stable position (when the effective pressure-point is applied in front of the primary front fulcrum 12) and would gradually pitch backward the more the effective pressure-point is moved behind the primary rear fulcrum 11 (when the platform is supported by its curved surface 33). In some embodiments, the curved surface 33 of the rear fulcrum 11 has a constant, adjustable or gradually changing radius of curvature between about 210 mm and about 270 mm to further provide a larger slightly more stable rear position for the user to feel that his effective pressure-point is displaced behind the desired area (stable area 13) and to give him a chance to adjust it.

Figure 4:
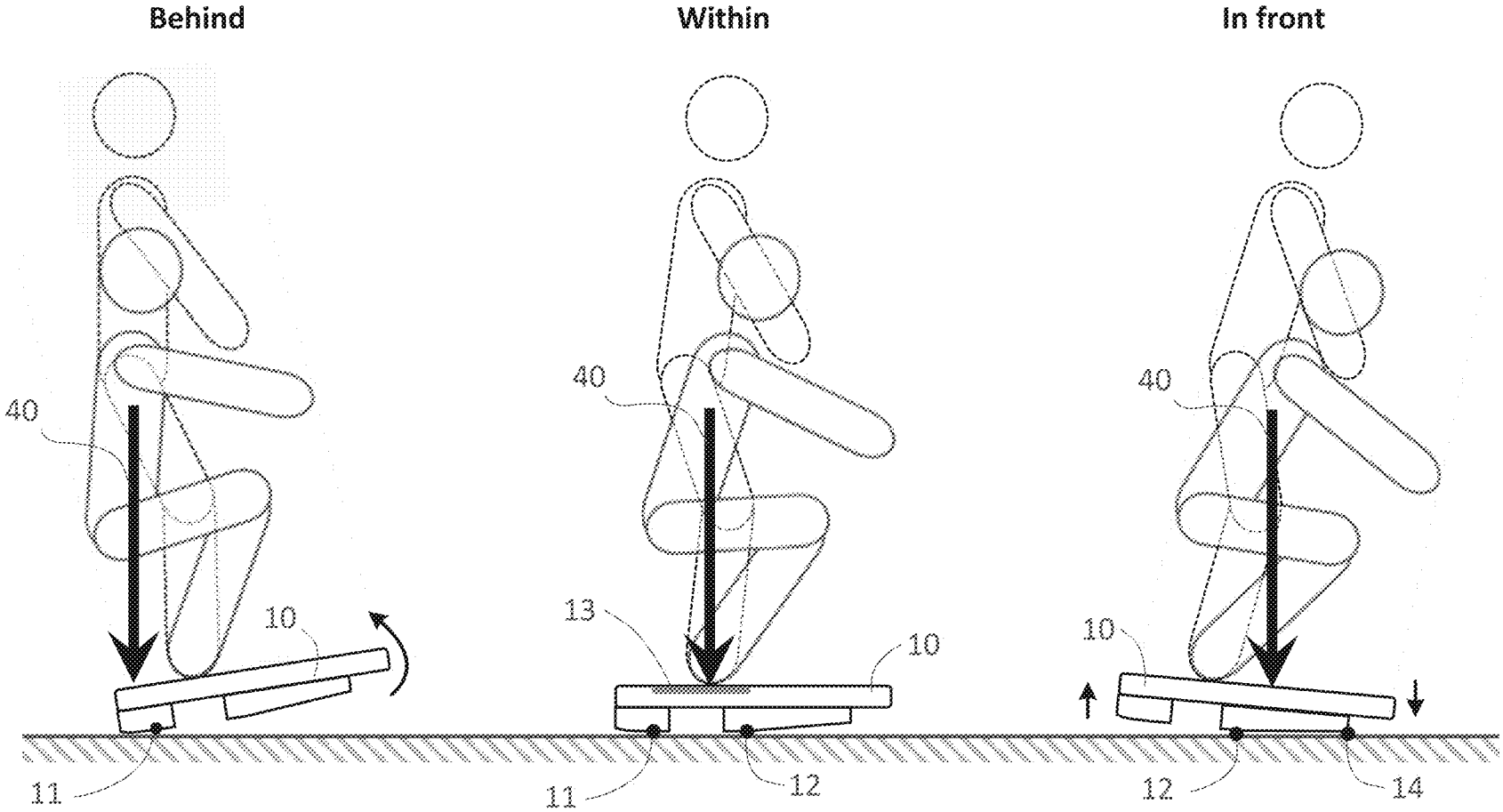
FIG. 4 illustrates the effect of moving of the user's center of mass on the platform relative to the first stable area.

FIG. 4 illustrates the dynamics involving the positioning of the user's center of gravity 40 relative to the top surface and the associated platform positions. Since this embodiment is fully stable for both the transversal and vertical axes, the only possible change in the platform's position is a rotation around the lateral axis or more precisely around the different fulcrums. The central configuration of FIG. 4 corresponding to the controlled position shows the platform's base position where the center of gravity 40 is maintained within the first stable area 13 (between the rear 11 and front 12 primary fulcrums) to keep the platform 10 in the primary stable position, which is horizontal in this embodiment. It can be appreciated that the user can move on the platform and perform the chosen exercises without having to constantly mind or readjust his balance when being provided with the primary stable position. Again, in some embodiments, this first stable area 13 can be adjusted as needed (enlarge, shorten, move forward or backward) by displacing the rear support 22 and/or front support 23 along the longitudinal axis. The right-side configuration of the illustration helps visualize the slight forward tilting of the platform corresponding to the secondary stable position in front of the primary stable position reached when the center of gravity 40 is centered above the relatively large second stable area between the primary front fulcrum 12 and secondary front fulcrum 14. It can be appreciated that the user can still complete the exercise he is executing since he is provided with the second stable area without being rocked out of balance during the transition of position (forward tilting over the primary front fulcrum 12) due to the selected small inclination of the platform's secondary stable position. The left-side configuration of the illustration helps visualize an optional backward tilting of the platform corresponding to an additional rear area behind the primary stable position reached when the center of gravity 40 is centered on or behind the primary rear fulcrum 11. In this embodiment, this rear area is corresponding to the curved surface 33 of the rear fulcrum 11 (best seen in FIGS. 3 and 8) which gradually tilts the platform backward when the user's center of gravity 40 gradually moves on it. Evidently, this optional additional rear area can be replaced with a variety of fulcrums, such as a stable position or can be subdivided in multiple areas (see embodiment FF of FIG. 8) for example, by adding more rear fulcrum (s).

Figure 5:
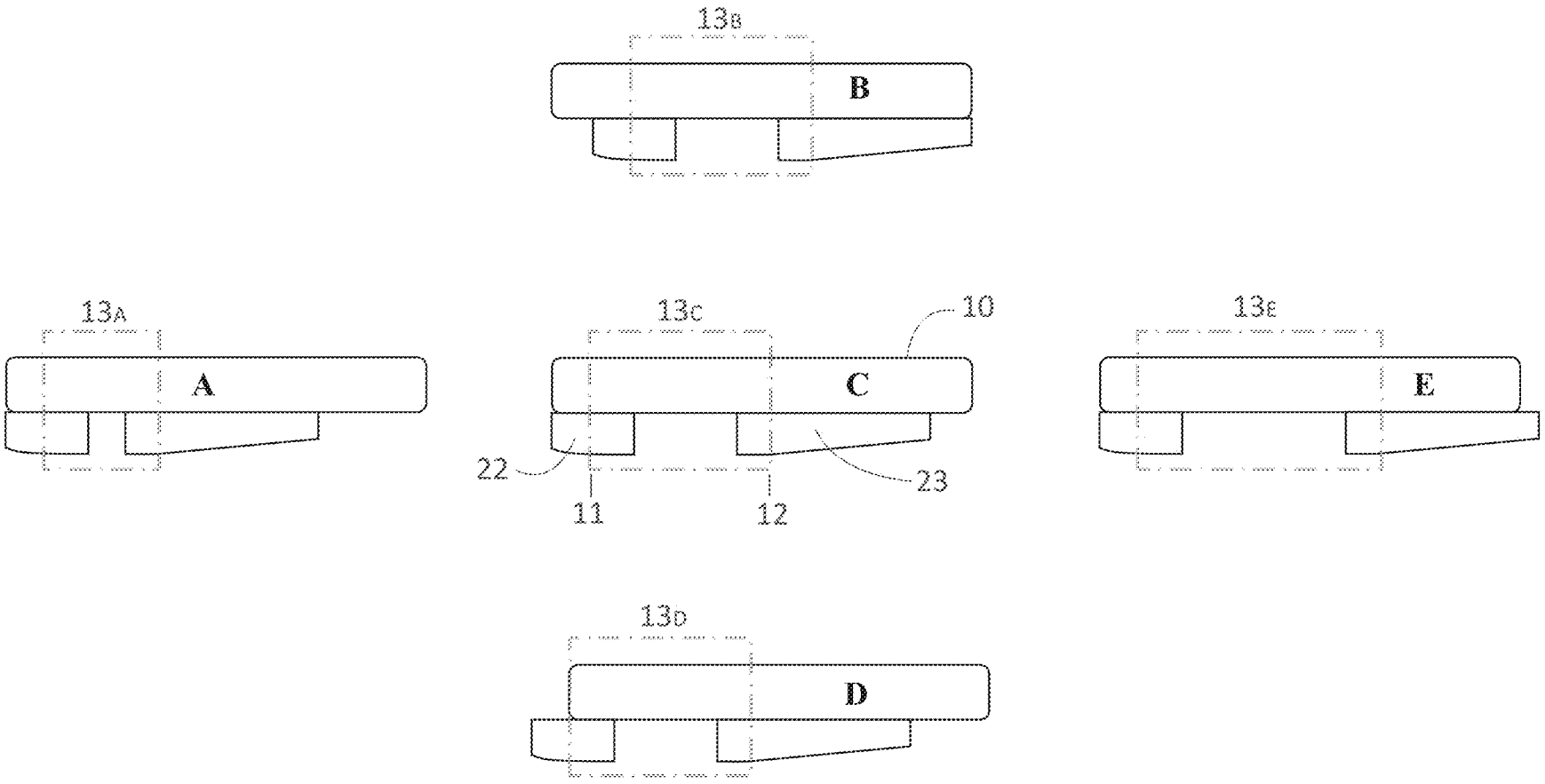
FIG. 5 illustrates a schematic side view of a variable first stable area of the platform as a function of the positions of the rear and front adjustable supports.

FIG. 5 illustrates a schematic side view of an embodiment with a variable first stable area of the platform and the different configurations displayed helps to understand the effects and possibilities of having such adjustable supports. The central configuration C is used here as a reference, where the first stable area 13*c* of this embodiment is limited between the primary rear fulcrum 11 on the rear support 22 and the primary front fulcrum 12 on the front support 23. Evidently, the surface size of the first stable area 13 can be reduced as seen in configuration A or lengthened as seen in configuration E. This allows the user to adjust the first stable area 13 to his body dimensions, for example the area $\mathbf{13}_E$ would be better fitted for a taller user, a user with larger feet or a beginner needing the forward tilting point to be further in front while keeping the same rear dynamics. Changing the position of the platform's supports can be used to translate the first stable area 13 relative to the platform 10 as seen in configuration B where it is moved forward and as seen in configuration D where it is moved backward. Someone skilled in the art will appreciate that the platform of configuration D can no longer be tilted backward due to the primary rear fulcrum 11 being parallel and directly under the rear limit of the platform, which means that the effective pressure-point applied by the user can no longer be applied behind the rear fulcrum. The same applies to any configuration where the primary rear fulcrum 11 is positioned behind the rear limit of the platform.

Figure 6:
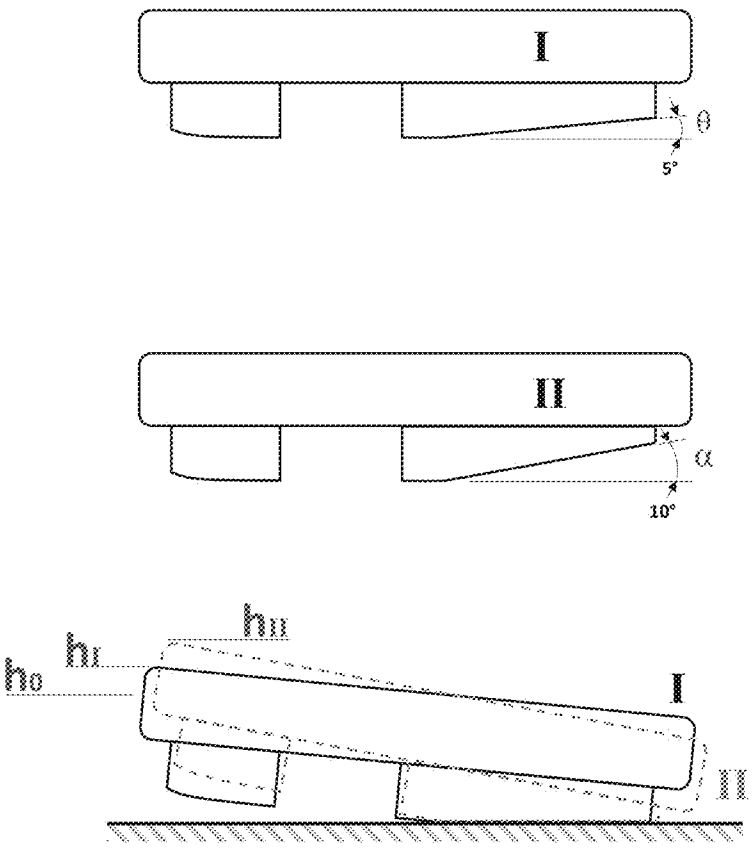
FIG. 6 illustrates a schematic side view of embodiments with different slopes for the secondary stable position and the effect thereof on the amplitude of the forward tilt displacement.

FIG. 6 illustrates the effect of increasing the inclination of the secondary stable position with respect to the primary stable position θ over the maximum values determined by the applicant, namely about 7 degrees. FIG. 6 presents illustrations of the first embodiment I with an inclination θ of 5 degrees (within the required limit), the second embodiment II with an inclination a of 10 degrees (over the required limit) and a superposed representation of the embodiments in their respective secondary stable position (the embodiment II showed in dashed lines). By comparing the secondary stable positions of embodiments with different inclinations it becomes evident that the maximum displacement heights h is, as expected from doubling the inclination angle, twice as more important for the embodiment II then for the embodiment I relative to the primary stable position's height h0.

Figure 7:
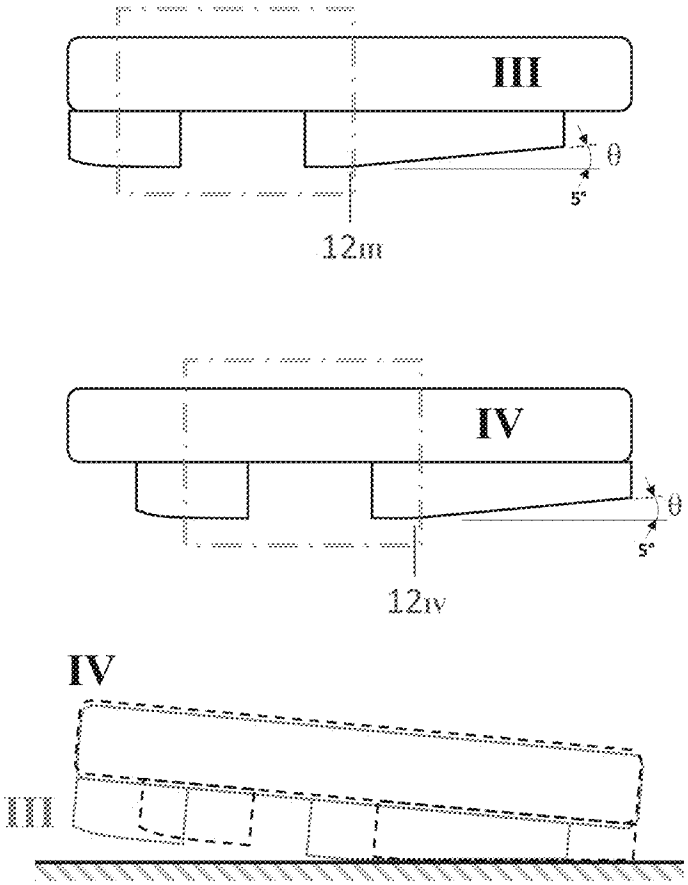
FIG. 7 illustrates a schematic side view of embodiments with identical first stable areas positioned at different positions on the platform and the effect thereof on the amplitude of the forward tilt displacement.

FIG. 7 illustrates the effect of displacing the first stable area's position or more specifically change the position of the primary front fulcrum on the secondary stable position and the related platform's arrangement. FIG. 7 presents embodiments with identical supports and stable area sizes, where the first arrangement III as a primary front fulcrum $\mathbf{12}_{III}$ behind the second arrangement's IV primary front fulcrum $\mathbf{12}_{IV}$ and a superposed representation of the embodiments in their respective secondary stable position (the second arrangement IV showed in dashed lines). By comparing the secondary stable position of these embodiments with different primary front fulcrum positions it becomes apparent that the gap between the platform's arrangements is not significatively affected by the change of the front support's position.

Figure 8:
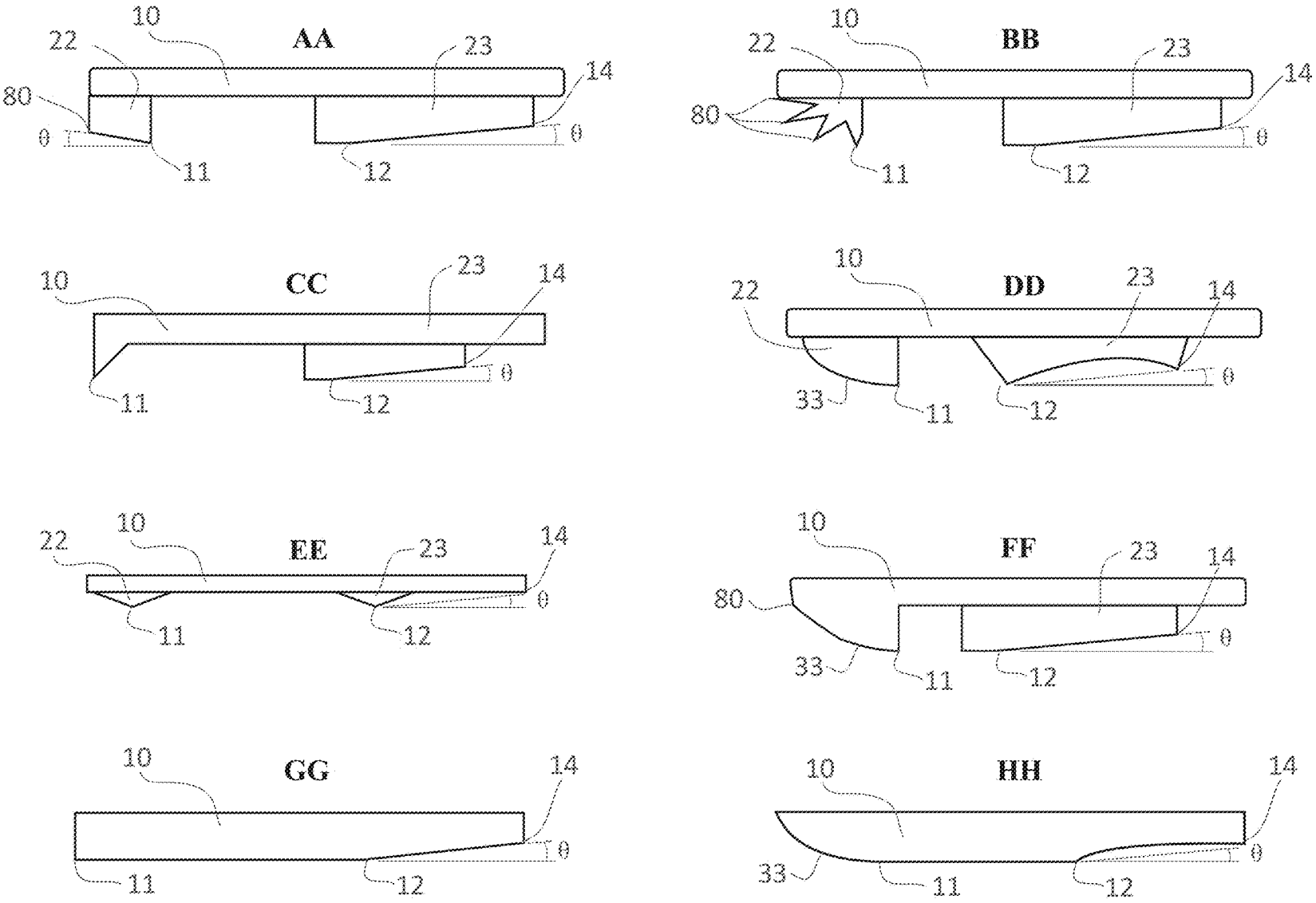
FIG. 8 illustrates schematic side views of various possible embodiments.

FIG. 8 shows some of the possible embodiments. Some supported by different adjustable front support 23 and/or rear support 22 (embodiments AA, BB, CC, DD and FF). Some with additional fulcrum(s) 80 for providing stable position(s) (embodiments AA, BB and FF) and/or for providing unstable position(s) (embodiments DD, FF and HH) with their curved surface 33. Some embodiments (GG and HH) have integrated fulcrums carved out of the bottom surface of the platform 10, others have their supporting bases fixed to the bottom surface of the platform 10 (embodiments EE).

Some embodiments may be equipped with a locking mechanism that will prevent the platform from tilting while the user is getting on top and positioning himself on the platform. This locking mechanism can be unlocked with the foot when ready to perform the chosen exercise. Other embodiments can be additionally equipped with a device producing sound cues triggered when added sensors detect the secondary fulcrum being engaged. All the embodiments previously presented can be used in any of the orientations around the vertical axis, such as sideways (±90 degrees), backward (180 degrees), etc. A person skilled in the art will understand that the platform and its supports can be made from any hard or stiff material that can prevent it to deform or lose its integrity when subjected to the maximal forces that could be applied or generated during the intended exercises.

What is claimed is:

1. An apparatus for improving control over a user's center of gravity, displacement, position or a combination thereof while executing an exercise, the apparatus comprising:

a platform having a top surface for supporting a standing user;

a primary rear fulcrum for supporting said platform;

a primary front fulcrum for supporting said platform, said platform able to be supported in a primary stable position on said primary rear fulcrum and said primary front fulcrum when an effective pressure-point of said standing user is positioned between said primary rear fulcrum and said primary front fulcrum;

a secondary front fulcrum for supporting said platform, said platform able to be supported in a secondary stable position on said primary front fulcrum and said secondary front fulcrum when an effective pressure-point of said standing user is positioned between said primary front fulcrum and said secondary front fulcrum; and an adjustable coupling mechanism comprising at least one linear track on a bottom surface of said platform for coupling at least one of said primary rear fulcrum, said primary front fulcrum, and said secondary front fulcrum to said platform at a desired position on said bottom surface of said platform;

wherein said secondary stable position has an inclination of between about 2 degrees and about 7 degrees with respect to said primary stable position.

2. A balancing board for improving control over a user's center of gravity, displacement, position or a combination thereof, the balancing board apparatus comprising:

a platform having a top surface for supporting a user standing on said platform with both feet;

a primary rear fulcrum for supporting said platform;

a primary front fulcrum for supporting said platform;

said platform able to be supported in a primary stable position on said primary rear fulcrum and said primary front fulcrum when an effective pressure-point of said standing user is positioned between said primary rear fulcrum and said primary front fulcrum; and a secondary front fulcrum for supporting said platform;

said platform able to be supported in a secondary stable position on said primary front fulcrum and said secondary front fulcrum when an effective pressure-point of said standing user is positioned between said primary front fulcrum and said secondary front fulcrum;

wherein said secondary stable position has an inclination of between about 2 degrees and about 7 degrees with respect to said primary stable position, wherein a position of at least one of said fulcrums is adjustable relatively to another one of said fulcrums without changing a shape of any of the fulcrums and without replacing any of the fulcrums.

3. The apparatus of claim 1, wherein said fulcrums have at least a contact point with said platform between the outer bound of the user's feet and the side edges of said platform to ensure lateral stability.

4. The apparatus of claim 1, wherein a bottom surface of said platform defines at least one of said primary rear fulcrum; said primary front fulcrum; and said secondary front fulcrum.

5. The apparatus of claim 2, further comprising a compatible coupling mechanism, wherein said coupling mechanism is used to couple at least one of said primary rear fulcrum, said primary front fulcrum and said secondary primary fulcrum to said platform.

6. The apparatus of claim 5, further comprising at least one graphic indicator for said coupling mechanism, wherein said graphic indicator is a visual cue for better aligning and positioning said at least one of said primary rear fulcrum, said primary front fulcrum and said secondary primary fulcrum relative to said platform.

7. The apparatus of claim 1, wherein said primary rear fulcrum comprises a curved surface, wherein said platform able to be supported in an unstable primary rear position on said curved surface of said primary rear fulcrum when said effective pressure-point of said standing user is positioned on said curved surface of said primary rear fulcrum.

8. The apparatus of claim 1, further comprising at least one additional rear fulcrum placed behind said primary rear fulcrum, wherein said additional rear fulcrum is further providing at least one of:

an additional unstable rear position on said additional rear fulcrum for supporting said platform when an effective pressure-point of said standing user is positioned on said additional rear fulcrum; and an additional stable rear position on said additional rear fulcrum and rear fulcrum placed in front of said additional rear fulcrum for supporting said platform when an effective pressure-point of said standing user is positioned between said additional rear fulcrum and said rear fulcrum placed in front of said additional rear fulcrum.

9. The apparatus of claim 2, further comprising a mat coupled to said top surface, wherein said mat increases the coefficient of friction between said user and said top surface.

10. The apparatus of claim 2, wherein said top surface is textured for at least one of:

a) creating a tactile cue for helping said user positioning on said platform, b) increasing the coefficient of friction between said user and said top surface, and c) providing constant feedback to said user about said effective pressure-point.

11. The apparatus of claim 1, further comprising at least one graphic element on said top surface, wherein said graphic element can serve as visual cue for helping said user positioning on said platform.

12. A method of improving control over a user's center of gravity, displacement, position or a combination thereof while execution an exercise comprising:

providing a board for a user to balance upon on a contacting surface and for improving said user's execution of an exercise in a primary stable position, wherein the board comprises:

a platform having a top surface for supporting a standing user;

a primary rear fulcrum for supporting said platform, said platform able to be supported in a primary stable position on said primary rear fulcrum and said primary front fulcrum when an effective pressure-point of said standing user is positioned between said primary rear fulcrum and said primary front fulcrum;

a secondary front fulcrum for supporting said platform, said platform able to be supported in a secondary stable position on said primary front fulcrum and said secondary front fulcrum when an effective pressure-point of said standing user is positioned between said primary front fulcrum and said secondary front fulcrum; and an adjustable coupling mechanism comprising at least one linear track on a bottom surface of said platform for coupling at least one of said primary rear fulcrum, said primary front fulcrum, and said secondary front fulcrum to said platform at a desired position on said bottom surface of said platform, wherein said secondary stable position has an inclination of between about 2 degrees and about 7 degrees with respect to said primary stable position;

executing said exercise while standing on said board and trying to keep said effective pressure-point between said primary rear fulcrum and said primary front fulcrum;

while executing said exercise, moving said effective pressure-point in front of said primary front fulcrum, disengaging said primary rear fulcrum, feel forward tilting of said board, engage said secondary front fulcrum and complete said exercise; and repeating said exercise until said effective pressure-point is strictly maintained between said primary rear fulcrum and said primary front fulcrum.

13. The apparatus of claim 2, wherein said adjustable position of said at least one of said fulcrums is free from a predetermined discrete position relative to another of said fulcrums or to said platform.

14. The apparatus of claim 1, wherein a position of said primary rear fulcrum and a position of said primary front fulcrum are adjustable relatively to said platform to change a position of said primary stable position relative to said platform.

15. The apparatus of claim 1, wherein a position of said primary rear fulcrum relative to said platform or a position of said primary front fulcrum or a position of said secondary front fulcrum is adjustable to reduce or increase a surface area of said primary stable position or to change a position of said primary stable position relative to said platform.

16. The apparatus of claim 1, wherein a position of said primary front fulcrum relative to said platform or a position of said primary rear fulcrum or a position of said secondary front fulcrum is adjustable to reduce or increase a surface area of said primary stable position or to reduce or increase a surface area of said primary stable position or reduce or increase a surface area of said secondary stable position or to change a position of said primary stable position relative to said platform or to change a position of said secondary stable position relative to said platform.

17. The apparatus of claim 2, further comprising at least one anchor to provide said adjustable position by coupling to said platform said at least one of the fulcrums having said adjustable position.

18. The method of claim 12, further comprising using said adjustable coupling mechanism to adjust the position of the at least one of said primary rear fulcrum, said primary front fulcrum, and said secondary front fulcrum to said platform at a desired position on a bottom surface of said platform.

19. The method of claim 12, further comprising using said adjustable coupling mechanism to adjust the position of at least two of said primary rear fulcrum, said primary front fulcrum, and said secondary front fulcrum to said platform at a desired position on a bottom surface of said platform.

20. The apparatus of claim 1, wherein a position of at least one of said fulcrums is adjustable relatively to another one of said fulcrums.

* * * * *